United States Patent [19]

Wear et al.

[11] Patent Number: 5,069,349

[45] Date of Patent: Dec. 3, 1991

[54] DISPLAY RACK STRUCTURE

[76] Inventors: Philip A. Wear, 5900 Carter La., Minnetonka, Minn. 55343; Stuart C. W. Wear, 5636 Rebecca La., Minnetonka, Minn. 55344

[21] Appl. No.: 594,721

[22] Filed: Oct. 9, 1990

Related U.S. Application Data

[63] Continuation-in-part of Ser. No. 541,040, Jun. 20, 1990, abandoned.

[51] Int. Cl.[5] ..... A47F 5/00

[52] U.S. Cl. ..... 211/59.3; 211/194

[58] Field of Search ..... 211/59.3, 59.2, 188, 211/194

[56] References Cited

U.S. PATENT DOCUMENTS

| | | | |
|---|---|---|---|
| 2,934,212 | 4/1960 | Jacobson | 211/59.3 |
| 3,083,067 | 3/1963 | Vos et al. | 211/59.3 X |
| 4,303,162 | 12/1981 | Suttle | 211/59.3 |
| 4,724,968 | 2/1988 | Wombacher | 211/59.3 |
| 4,762,236 | 8/1988 | Jackle, III et al. | 211/59.3 |
| 4,898,282 | 2/1990 | Hawkinson et al. | 211/59.3 X |
| 4,901,869 | 2/1990 | Hawkinson et al. | 211/59.3 |
| 4,907,707 | 3/1990 | Crum | 211/59.3 |

*Primary Examiner*—Robert W. Gibson, Jr.
*Attorney, Agent, or Firm*—Leo Gregory

[57] ABSTRACT

A multi-level display rack structure which holds merchandise at two or three levels on grocery shelves and upon which packaged goods are carried and spring urged backing members move the merchandise to the forward edges of the rack at each level as items thereon are removed by purchase.

11 Claims, 4 Drawing Sheets

DISPLAY RACK STRUCTURE

This is a continuation-in-part of applicant's copending application, Ser. No. 541,040 filed June 20, 1990, abandoned.

BACKGROUND OF THE INVENTION

1. Field Of The Invention

This invention relates to display racks for merchandise shelves as in general merchandise stores.

2. Brief Description of the Prior Art

For the most part, general merchandise outlets which shelve goods, stack items between regular full length shelves which are generally spaced apart vertically on the order of twelve inches. The stacking is disturbed by customers and requires attention to be maintained in a neat order. Further, from time to time, the unsold goods need to be advanced to the forward edge of the shelving.

It is desirable to have a more efficient manner in which to maintain shelved stocks such as by having them to a considerable extent be self-maintained.

SUMMARY OF THE INVENTION

This invention relates to a multi-level merchandise display rack particularly adapted to be placed on conventional store shelving within the vertical spacing between such shelving and to carry merchandise for display and sale, each individual rack having a spring urged backing member which automatically moves the goods thereon to the forward edge thereof as each item of the goods is removed by sale.

DESCRIPTION OF A PREFERRED EMBODIMENT

Figure 1:
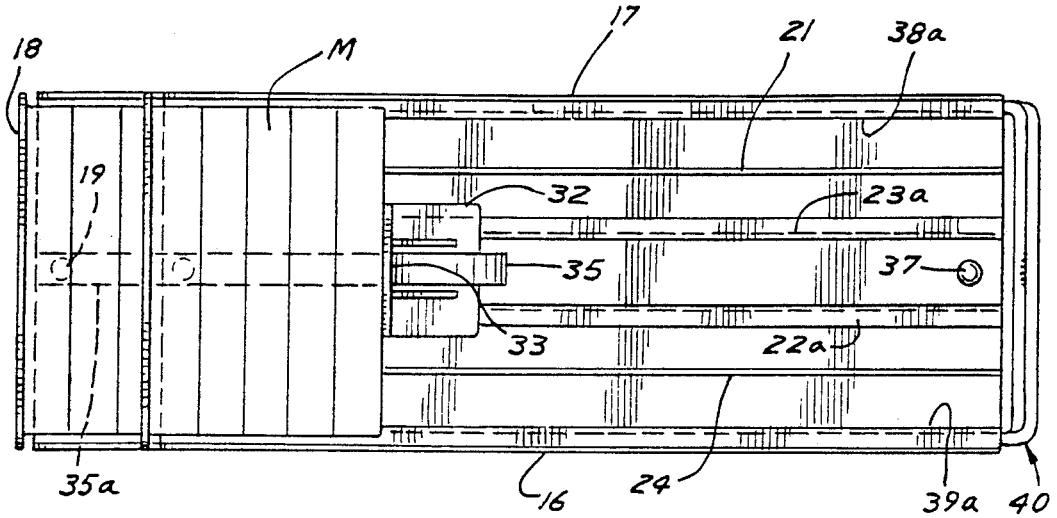
FIG. 1 is a top plan view.

Referring now to the Figs. and particularly to FIGS. 1-5, the display structure herein is indicated generally by the reference numeral 10.

Said structure as here shown consists of racks or trays 12 and 13 mounted one elevated above the other as will be described.

The bottom or base rack 12 has a bottom wall 15 substantially rectangular in plan and has a length which corresponds with the depth of a conventional store shelf, such as in a grocery store. The rack or tray is conveniently extruded of a fairly rigid suitable plastic material. Side walls 16 and 17 extend lengthwise of said rack having depending portions 16*a* and 17*a* forming supports or legs which provide a relative friction free bottom for sliding the rack in position on a shelf.

A front wall 18 is at the front end of said rack, the same having a right angled portion 18*a* underlying the front end portion of said rack and being secured, as here shown, by a nut and bolt 19.

Upstanding from said bottom wall 15 are longitudinal extending ribs 21-24. Said ribs provide an easy sliding support surface for articles of merchandise M placed thereon.

The central of said ribs, 22 and 23 have oppositely extending flanges 22*a* and 23*a*.

Supported by and riding on said central flanges is a ram member 25 having an upstanding backing plate member 26 having a rearward right angled base 27 which has depending inwardly angled flanges 28 and 29 at each side thereof said flanges interengaging said flanges of said ribs 22 and 23 and said base is slidable on said ribs. A pair of spaced walls 31 and 32 extend upwardly from said base at the rear side of said plate member, base at the rear side of said plate member, said walls tapering upwardly. A slot 33 is formed in said base between said walls. A coiled flat plate spring 35 is positioned upon said base between said walls, thereon and the forward position of said spring 35*a*, is pulled forwardly to be secured at the front edge of said rack by said bolt 19.

Thus it is seen that when said plate member 26 is positioned rearwardly of said rack, the spring is uncoiled and provides pressure against said plate member to urge it forwardly.

Items of goods placed on said rack will fill space between said plate member and said front wall to the full extent of said rack and as each item of merchandise is removed, the remainder are moved forwardly automatically by the action of said spring 35.

An upstanding pin 37 at the rear end of said bottom wall forms a stop member.

Adjacent the inner side juncture of said bottom wall and said side wall channels 38 and 39 are formed by upstanding ribs 38*a* and 39*a* spaced from said side walls and flanges 38*b* and 39*b* extending inwardly from said side walls to overlie said ribs.

Figure 2:
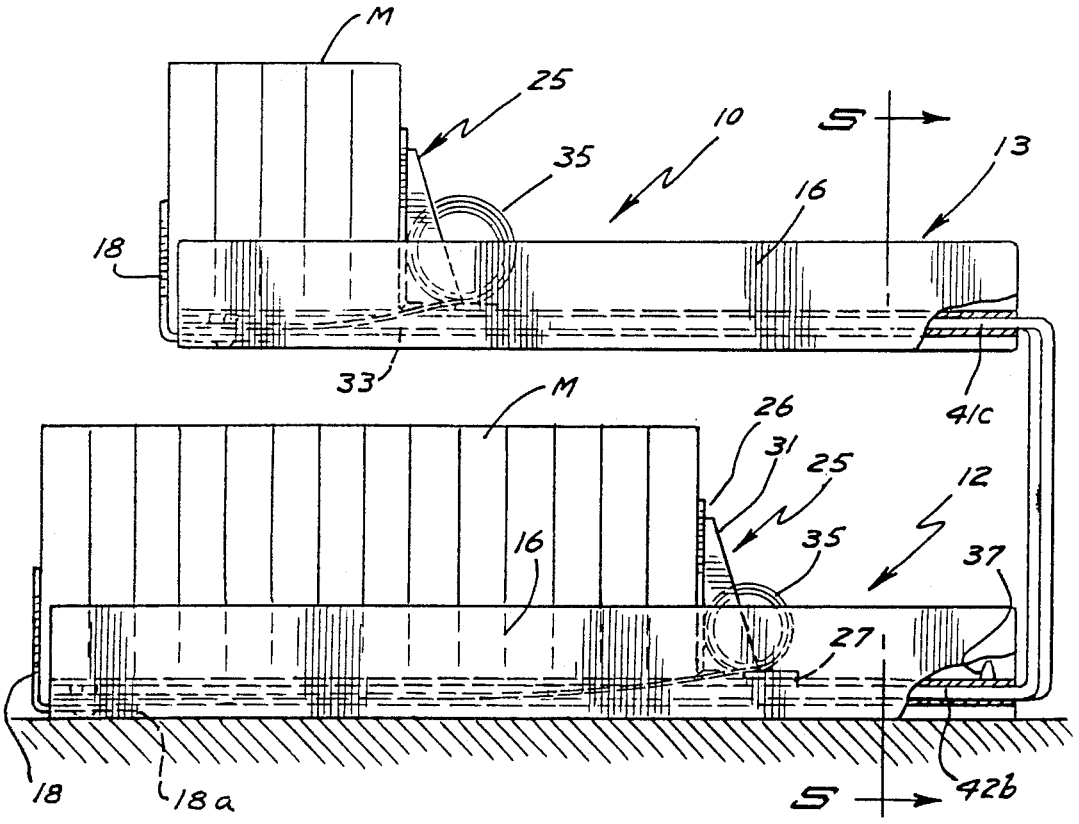
FIG. 2 is a side elevational view with some parts being broken away.

Now, with reference to FIG. 2, rack 14 is shown in an elevated position. The description of the rack 12 is representative of the description of rack 14 with the exception that rack 14 is of a lesser length. The same reference numbers are used to refer to like parts of the rack 14 with a prime added.

An elevating or stacking support member 40 is provided. The same is here illustrated as being formed of a wire of suitable guage and rigidity. Said elevating member may take various forms. It is here shown as two U-shaped members 41 and 42, each disposed on a side and having their end walls 41*a* and 42*a* crossed forming an X as at 43 in FIGS. 4 and 5, The extended arms 41*b-c* and 42*b-c* are respectively disposed the channels 38, 39 and 38', 39' as shown, and are frictionally held therein.

In operation, the structure is assembled as described and is loaded with articles of merchandise M as indicated in FIG. 2 and then placed on a shelf in a desirable location, or in the alternative, the rack may be positioned where desired in an unloaded condition and subsequently loaded with the merchandise to be displayed and stocked thereon.

The merchandise or goods on said rack in being positioned between the front wall 17 and the ram or backing plate member 26 and being constantly urged forwardly by the backing plate is always in a neat appearing condition leaving no empty spaces and always has the goods in a neat appearing condition.

Figure 7:
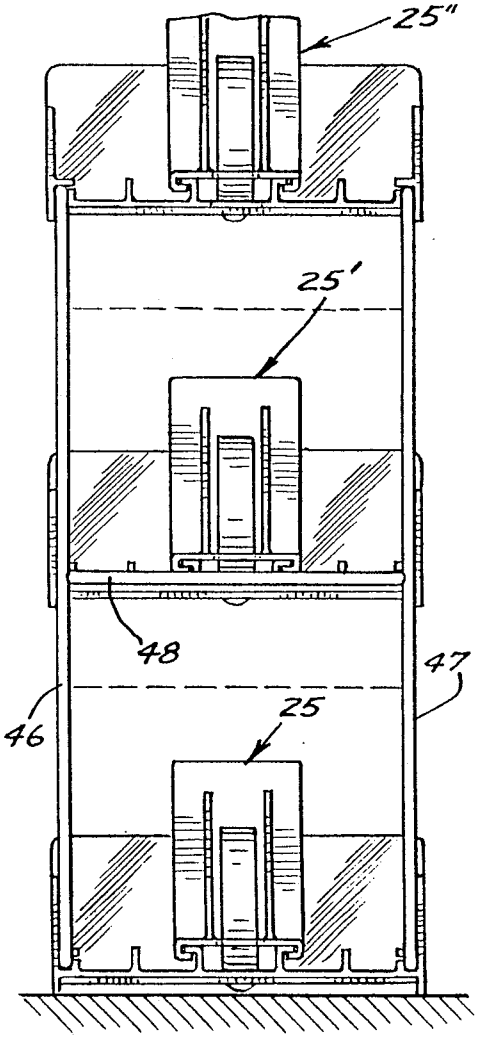
FIG. 7 is a view similar to that of FIG. 6 in rear elevation.
Figure 6:
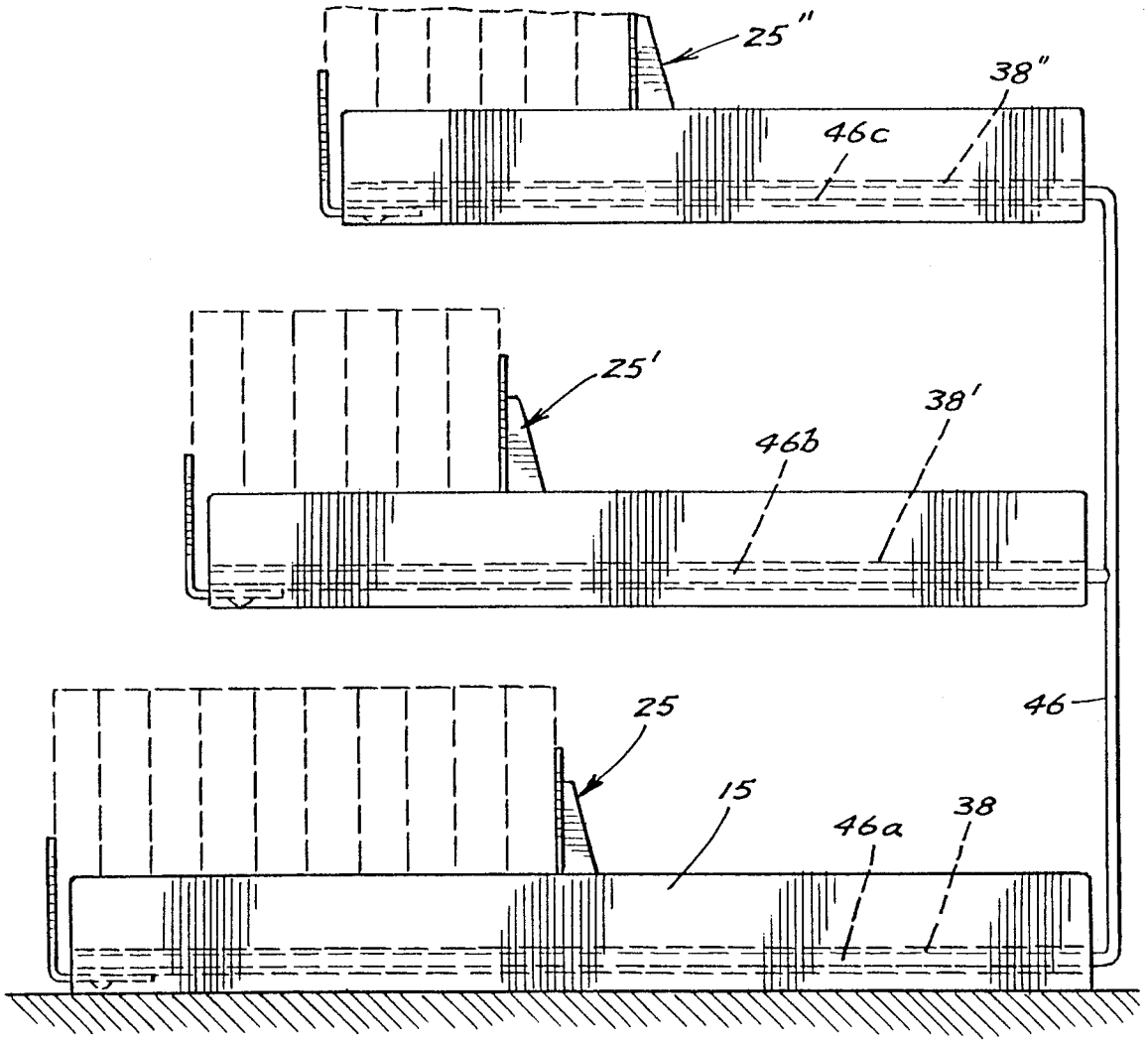
FIG. 6 is a modification showing some portions thereof in dotted line.

With reference to FIGS. 6 and 7, the rack structure herein is shown as a three level structure with the third level rack being indicated by the reference numeral 14.

With the exception of being somewhat shorter than the rack 13, said rack 14 the same as rack 12 hereinbefore described and the like parts therein are indicated by like reference numerals with a double prime added.

Further with reference to FIG. 7, it is noted that the support 45 for elevating the racks is formed of two wire E shaped members 46 and 47 which are connected by a cross bar 48. The forwardly extending arms thereof such as the arms 46*a, b* and *c* are disposed into channels 38, 38' and 38'', as shown in FIG. 6, as previously described.

Figure 8:
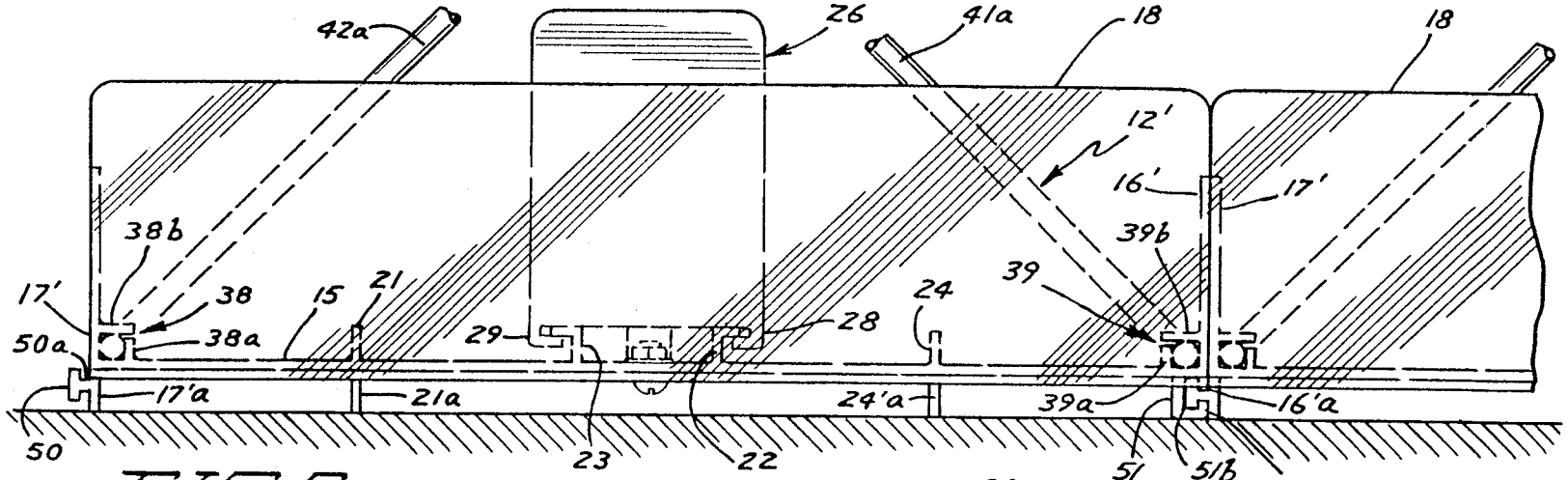
FIG. 8 is a view in front elevation of a modification.
Figure 9:
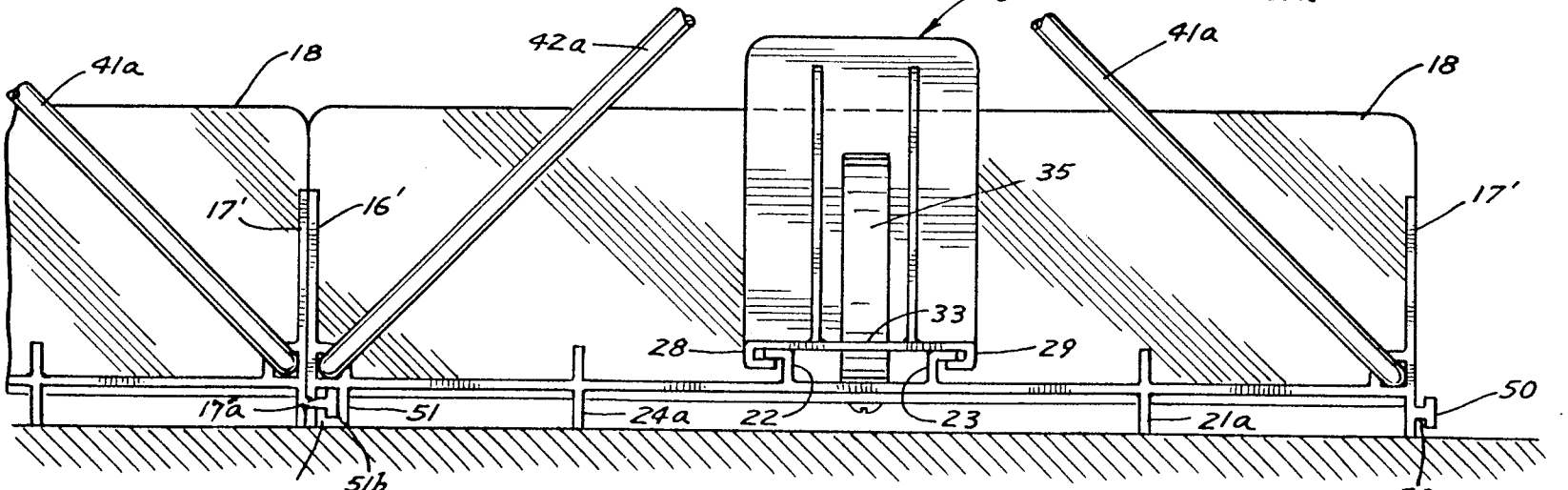
FIG. 9 is a view in rear elevation of the modification.

Referring to FIGS. 8 and 9, a modification is shown with particular reference to the structure of the tray 12 which is indicated in the modified form as 12'. All like parts of the tray 12' previously described will bear the same reference characters with the previous description applying and the modified of said parts will bear like reference characters with a prime added.

The principal modification in said tray 12' embodies interlocking means for releasably securing adjacent trays in a side by side relation.

As shown in FIG. 8, projecting outwardly of the depending portion 17'*a* of the side wall 17' and extending along said side wall is a horizontal tee shaped rail 50 forming a male interlocking or interengaging member.

Referring to the side wall 16' and its intersection with the bottom wall 15, the depending leg portion 16'*a* of the side wall 16' is reduced in length relative to the part 16*a* as indicated. Set back therefrom and depending from said bottom wall is an angled channel member 51 as shown and having a shortened upstanding outside wall 51*a* which provides a slot 51*b* between itself and the depending leg portion 16'*a*. Said slot opening is sufficient to permit the web 50*a* to slide therethrough. Said channel member extends the length of said tray 12' and has therein a channel 51*c* adapted to receive therein the tee rail 50 of an adjacent tray.

Thus it is seen that adjacent of said tray structures may be assembled side by side in a releasable locked engagement.

Figures 3, 4, 5:
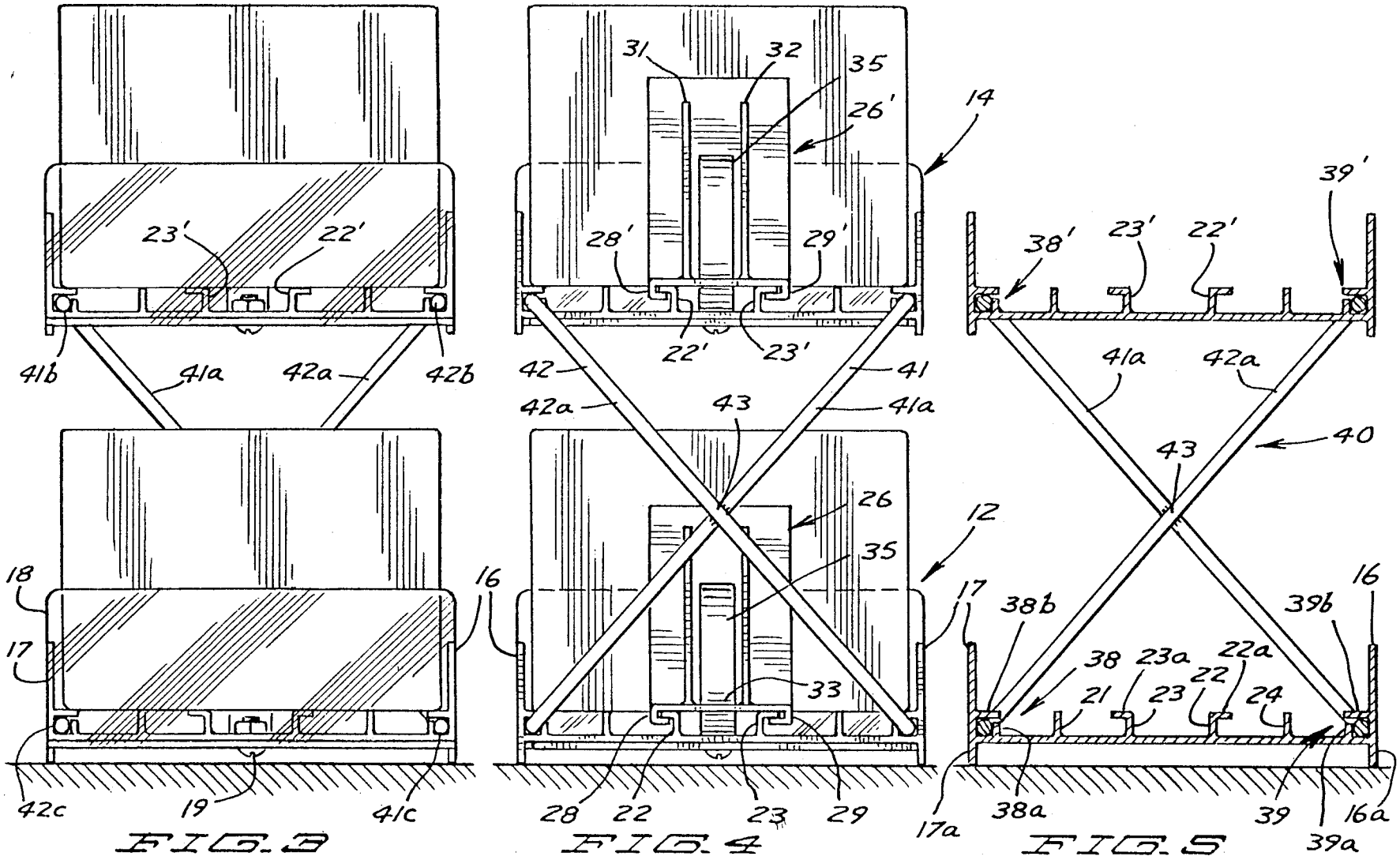
FIG. 3 is a view in front elevation.
FIG. 4 is a view in rear elevation.
FIG. 5 is a view in vertical section taken on line 5—5 of FIG. 2 as indicated.

It is shown that in a duplex or elevated tray arrangement, that the elevated tray will be of the structure as illustrated in FIGS. 4 and 5. However embodied within the concept herein, although not illustrated, is the elevation of trays such as the tray 12' in an interlocked or interengaged position.

Thus there is provided a display structure in which the rack levels may be readily varied to accommodate the vertical shelving space into which it may be conveniently positioned. The structure is adapted to very nicely maintain the goods contained therein in a forward easily viewed position.

It will of course be understood that various changes may be made in form, details, arrangement and proportions of the product without departing from the scope of the invention which, generally stated, consists in a product capable of carrying out the objects above set forth, in the parts and combination of parts disclosed and defined in the appended claims.

What is claimed is:

1. A multi-level shelf display structure comprising, a base rack having a bottom wall, side walls and a front wall, longitudinal transversely spaced ribs extending upwardly of said bottom wall, a ram member comprising an upstanding plate having a supporting base, said base being seated upon said ribs, means slidably interengaging said base and said ribs, means connecting said ram member and said base automatically urging said ram member forwardly of said base, a channel at each side of said rack, a second rack of the structure of said first mentioned rack spaced thereabove, supporting means maintaining said racks in spaced relation, said supporting means having vertically spaced forwardly extending arms, and said arms being respectively frictionally disposed into said channels of said racks,

2. The structure set forth in claim 1, wherein said first mentioned means comprises a pair of angled side walls depending from said ram base, a central pair of said ribs having oppositely angled upper end flanges, whereby said angled side walls underengage said oppositely angled flanges.

3. The structure set forth in claim 1, wherein said second mentioned means comprising a coiled plate spring, the forward end portion of said plate spring extending to the forward edge portion of said rack, and means securing said forward end portion of said plate spring to said rack.

4. The structure of claim 1, wherein said channel at each side of said rack being internally disposed at each side of the junctures of said rack and its respective side walls.

5. The structure of claim 1, wherein said supporting means comprise wire frame members of a suitable guage and rigidity.

6. The structure of claim 1, including a stop member adjacent the rear end portion of said rack.

7. A multi-level shelf display structure, comprising a rack having a substantially rectangular bottom wall, side walls and a front end wall, longitudinal transversely spaced ribs extending upwardly of said bottom wall, a central pair of said ribs having upper end flange portions, a pair of internal channels at the junctures of said bottom wall and the respective side walls thereof, a ram member having a base portion seated upon said central pair of said ribs, means slidably interengaging said ram base portion and said ribs, self-retractable means carried by said ram member, said retractible means having a free end portion, means securing said free end portion of said retractible means to the forward end portion of said bottom wall, a second rack of the structure of said first mentioned rack elevated thereabove, supporting means retaining said racks in vertically spaced relation, said supporting means having extending vertically spaced arm portions, said arm portions being respectively disposed into their respective internal channels supporting said racks in vertically spaced relation.

8. The structure of claim 7, including a third rack of the structure of said second rack elevated thereabove, and said supporting means being adapted to retain said second and said third mentioned racks in their respective elevated positions relative to said first mentioned rack.

9. The structure of claim 8, wherein said second mentioned rack is set back relative to said first mentioned rack and said third mentioned rack is set back relative to said second mentioned rack.

10. The structure of claim 1, wherein a tee shaped rail extends along one of said side walls, a channel member having a slot therein being coextensive with the other of said side walls, whereby adjacent of said base racks are adapted to have interengagement of said rail and said channel for a side by side interlocking engagement.

11. A shelf display structure comprising, a rack having a bottom wall, side walls and a front wall, longitudinal transversely spaced ribs extending upwardly of said bottom wall, a ram member comprising an upstanding plate having a supporting base, said ram base being seated upon said ribs, means slidably interengaging said ram base and said ribs, means connecting said ram member and said bottom wall of said rack automatically urging said ram member forwardly of said rack, a tee shaped rail projecting along the underside of one of said side walls, a channel member being coextensive with the other of said side walls, whereby adjacent of said racks are adapted to have interengagement of said rail and said channel for a side by side interlocking engagement.

* * * * *